US005944257A

United States Patent [19]

Dietiker et al.

[11] Patent Number: 5,944,257

[45] Date of Patent: Aug. 31, 1999

[54] BULB-OPERATED MODULATING GAS VALVE WITH MINIMUM BYPASS

[75] Inventors: Paul Dietiker, Redondo Beach, Calif.; Johan H. Pragt, Coevorden, Netherlands

[73] Assignee: Honeywell Inc., Minneapolis, Minn.

[21] Appl. No.: 08/933,131

[22] Filed: Sep. 18, 1997

Related U.S. Application Data

[63] Continuation of application No. 08/751,010, Nov. 15, 1996, abandoned.

[51] Int. Cl.[6] ..... G05D 23/12

[52] U.S. Cl. ..... 236/80 B; 236/80 E; 236/80 F; 137/599

[58] Field of Search ..... 236/1 E, 80 B, 236/80 E, 80 F; 137/599, 601

[56] References Cited

U.S. PATENT DOCUMENTS

| | | | |
|---|---|---|---|
| 3,126,911 | 3/1964 | Galley | 137/495 |
| 3,559,884 | 2/1971 | Visos et al. | 236/80 F |
| 3,578,243 | 5/1971 | Love | 236/80 B |
| 3,688,981 | 9/1972 | Sidaris | 236/80 |
| 3,810,578 | 5/1974 | Matthews | 236/80 B |
| 4,009,861 | 3/1977 | Hirst | 251/61.1 |
| 4,254,796 | 3/1981 | Kelly | 137/489 |
| 4,406,400 | 9/1983 | Berkhof | 236/80 F |
| 4,457,291 | 7/1984 | Henke | 126/21 A |
| 4,610,269 | 9/1986 | Kelly | 137/599 |
| 4,790,352 | 12/1988 | Dietiker et al. | 137/613 |

*Primary Examiner*—William E. Tapolcai
*Attorney, Agent, or Firm*—Charles L. Rubow

[57] ABSTRACT

A multi-way valve unit which provides low pressure unregulated gas flow and high pressure regulated gas flow in an integrated gas control system. A main and bypass diaphragm valves control gas flow through the gas valve system, the main and bypass valves being opened by pressure differentials on their respective valve diaphragms. A regulator valve and a snap valve modify gas pressure applied to the main and bypass valves diaphragms respectively. A control means actuates the regulator and snap valves based on degree of temperature deficiency sensed in a monitored space. The control means opens the snap valve to provide unregulated gas flow when low gas pressure is required, and opens the regulator valve to provide regulated high flow when high gas pressure is required.

22 Claims, 6 Drawing Sheets

BULB-OPERATED MODULATING GAS VALVE WITH MINIMUM BYPASS

This application is a continuation of application Ser. No. 08/751,010, filed Nov. 15, 1996, now abandoned.

BACKGROUND OF THE INVENTION

The present invention relates to fluid handling systems, and more specifically to a multi-way valve unit having a regulated main valve, and an unregulated minimum bypass valve.

One common method of regulating gas flow is with a diaphragm valve. While many mechanisms exist to control the diaphragm valve, one popular method uses the inlet port pressure to control the position of a valve seat-engaging member relative to the valve seat, movement of the seat-engaging member being controlled by a valve diaphragm. Basically, this is accomplished by creating a pressure differential from one side of the valve diaphragm to the other sufficient to displace the diaphragm and the associated seat-engaging member. In simplest form, the seat-engaging member may be an integral part of the diaphragm. In more complicated systems, the valve diaphragm is mechanically linked to a separate seat-engaging member. The distance between the valve seat and the seat engaging member determines the valve opening, and thus the gas pressure at the outlet port.

A disadvantage of this control method is that any undesirable variations in the inlet pressure will be reflected in the outlet pressure, especially at low outlet pressures. For higher outlet gas pressures, these variations become negligible. Specifically, conventional diaphragm operated valves cannot provide acceptable pressure characteristics under approximately 0.3" water column (w.c.). Thus the operating range of the diaphragm valve is substantially limited at low pressures by these inlet pressure variations.

Many popular gas control techniques would benefit from a valve system providing an extended operating pressure range at low pressures. One common example is so-called "on-demand" gas heating systems. In on-demand systems, fuel gas is provided only when there is a demand for heat. The demand is met by supplying only enough gas to exactly meet the needs of the application. For example, in a gas system for hot water supply, low gas pressure may be used to provide hot water to a sink, but high pressure will be provided if the shower is turned on. As a second example, in a space heating system, low gas pressure may be provided to raise the temperature by several degrees, but high gas pressure will be provided if the temperature in the controlled space is substantially below the desired temperature.

Valve systems providing both high and low controlled gas pressure also find application in slow-opening gas valve systems. Slow-opening gas valves have become a common means of improving the start-up characteristics of gas burner systems. In these applications, ramping to full gas pressure follows an initially low gas pressure period. In systems without improved start-up, initial full gas pressure may cause a dangerous gas flash to occur upon ignition. Although this flash is usually contained within the burner chamber, it also typically causes uncombusted gas to be propelled out of the burner chamber. By using low gas pressure on start-up, the initial start-up flash is essentially eliminated. This improves both the safety and the efficiency of the burner system.

Several workable slow-opening solutions exist which provide initial low gas pressure. U.S. Pat. No. 4,790,352 to Dietiker, et al is one such patent. In the Dietiker patent, gas pressure is ramped to full gas pressure, thus preventing the aforementioned flash problem. U.S. Pat. No. 4,254,796 to Kelly describes another such system. In the Kelly patent, low gas pressure is only provided for a short initial period followed by full valve opening. Neither system however, can provide continuous regulated gas pressure control at low pressures.

Other systems may exist to provide separate low pressure and high pressure gas supply. These systems do not however provide integrated solutions for controlled low gas pressure and high regulated gas pressure in the same valve system.

Accordingly, the applicants have endeavored to provide a gas valve system which smoothly integrates a diaphragm operated valve capable of over approximately 0.3" w.c. pressure regulation with a valve capable of controlled unregulated pressure under approximately 0.3" w.c. Furthermore, the applicants have provided for common control of the high and low gas pressure in a system which minimizes overall component count, and which achieves a smooth transition from low pressure to high pressure operation.

SUMMARY OF THE INVENTION

The present invention is a multi-way valve system capable of providing high pressure regulated gas flow and low pressure unregulated gas flow in an integrated system. The system is defined externally by an inlet port and an outlet port. A main valve is provided, having a main valve seat and main seat-engaging member, which when in contact, separate the inlet port from the outlet port, and when separated allow direct communication therebetween. The main valve also includes a main valve diaphragm which controls movement of the main valve seat-engaging member into and out of contact with the main valve seat. A main valve chamber is isolated from the flow path between the inlet and outlet ports by the main valve diaphragm. A first passage having a first flow restrictor, connects the main valve chamber and the inlet port.

A bypass conduit provides direct communication with the outlet port. The bypass conduit includes a bypass flow control element. A bypass valve, having a bypass valve seat and a bypass seat-engaging member, separates the inlet port and the bypass conduit when closed, and allows direct communication therebetween when open. The bypass valve also includes a bypass valve diaphragm which controls movement of the bypass seat-engaging member into and out of contact with the bypass valve seat. A bypass valve chamber is isolated from the flow path between the bypass conduit and the inlet port by the bypass valve diaphragm. A second passage having a second flow restrictor, connects the bypass valve chamber and the inlet port.

A third passage connects the main valve chamber and the outlet port. The third passage includes a regulator valve which obstructs flow through the third passage when closed, and allows flow therethrough when open. A fourth passage connects the bypass valve chamber and the outlet port. The fourth passage includes a snap valve which obstructs flow through the fourth passage when closed, and allows flow therethrough when open. Lastly, a primary control device is supplied. The primary control device includes a temperature sensitive element, which causes the snap valve to open when the temperature sensitive element indicates a slightly lower than desired temperature, and causes the regulator valve in the third passage to open when the temperature sensitive element indicates a substantially lower than desired temperature.

DESCRIPTION OF THE PREFERRED EMBODIMENT

Figure 1A:
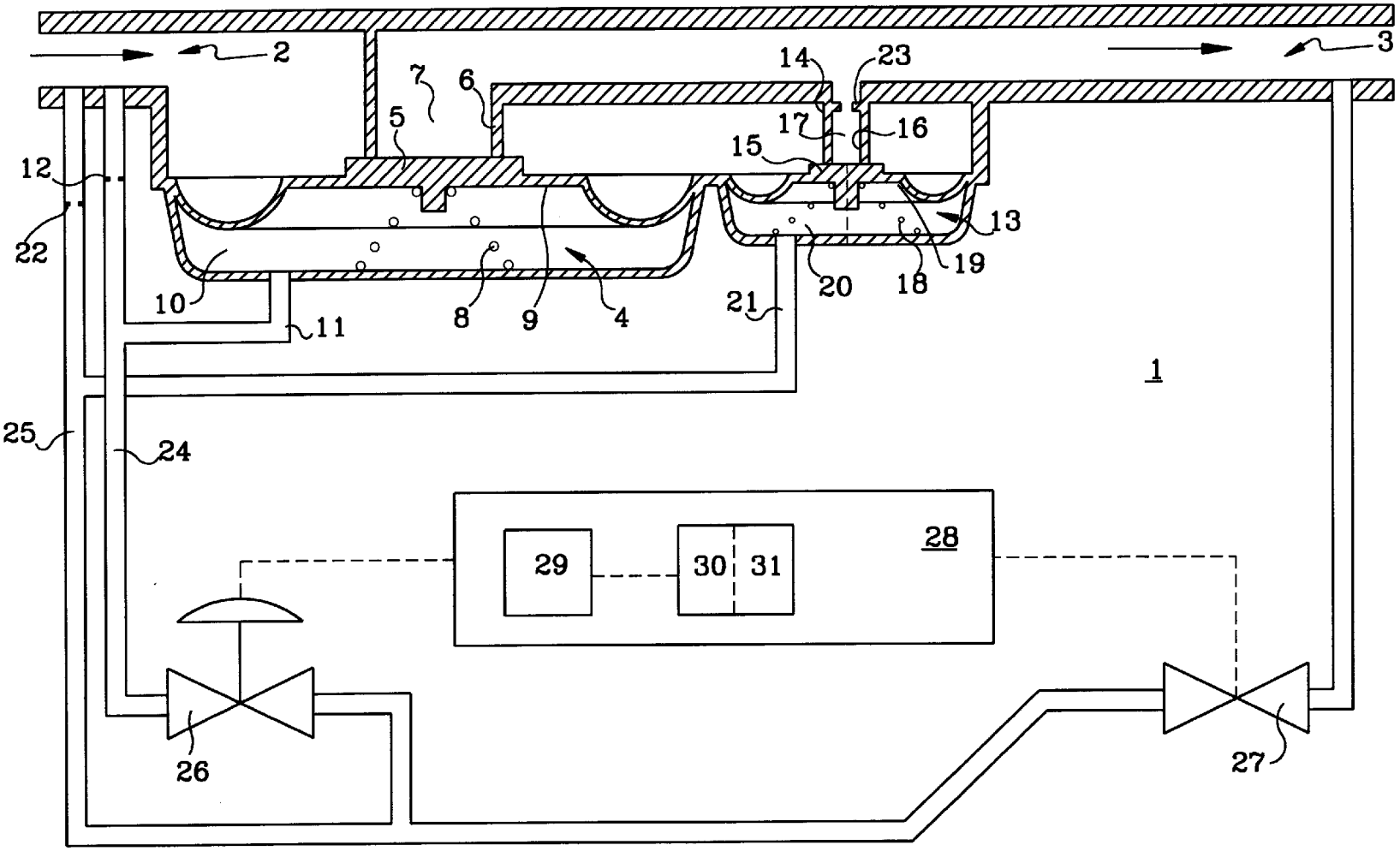
FIG. 1A depicts a partial block diagram of one embodiment of the present invention.

FIG. 1A depicts, partially in block diagram form, one embodiment of the present invention. Reference numeral 1 generally identifies the complete multi-way valve unit of the present invention. While the applicants believe that implementation of the design in a single housing or casting is the preferred method of implementation, it would also be possible to perform the disclosed invention using discrete system components. An inlet port 2 and an outlet port 3 respectively provide gas flow into and out of gas valve 1. A main valve, indicated by numeral 4 in FIG. 1A, controls the main gas flow from the inlet port to the outlet port. The main valve may be considered, and will be referred to as, a first or primary diaphragm valve. A main seat-engaging member 5 generally lies adjacent inlet port 2, and is capable of sealably engaging a main valve seat 6. A main seat passage 7 through main valve seat 6, when open, connects the inlet and outlet ports. A spring 8, or other means urges the main valve seat-engaging member against main valve seat 6. Engaging the main seat-engaging member to the main valve seat prevents gas flow from the inlet port to the outlet port. When the main seat-engaging member does not engage the main valve seat, gas flows from the inlet port, through main seat passage 7 in the main valve seat, to the outlet port.

The main seat-engaging member in this embodiment is part of a main diaphragm 9, which separates a main valve chamber 10, from the inlet port. While this embodiment depicts the seat-engaging member as part of the main valve diaphragm, they may be separate. In systems where the main seat-engaging member is not part of the main valve diaphragm, a mechanical linkage connects the main valve diaphragm to the main seat-engaging member so that movements of the main valve diaphragm are reflected in the main seat-engaging member. The position of the main valve diaphragm reflects pressure differences between the main valve chamber and the inlet port. A pressure drop from the inlet port to the main valve chamber works against spring 8 to urge the main valve open. Equal pressure or a pressure rise from the inlet port to the main valve chamber will work in concert with spring 8 to hold the main valve in a closed position.

A first passage 11, provides gas flow between the inlet port and the main valve chamber. A first flow restrictor 12 reduces the flow of gas from the inlet port to the main valve chamber via this first passage.

A bypass valve 13 controls bypass gas flow from inlet port 2 to a bypass conduit 14. The bypass valve may be considered, and will be referred to as a second or secondary diaphragm valve. A bypass seat-engaging member 15 generally lies adjacent inlet port 2, and sealably engages a bypass valve seat 16. Bypass conduit 14 connects a seat passage 17 through the bypass valve seat to the outlet port. A bypass flow control element 23 restricts the flow of gas through bypass valve 13. A spring 18, or other means urges the bypass seat-engaging member against bypass valve seat 16. When the bypass seat-engaging member engages the bypass valve seat, gas flow from the inlet port to the bypass conduit is prevented. When the bypass seat-engaging member is lifted from the bypass valve seat, gas flows from the inlet port through bypass seat passage 17 in the bypass valve seat to bypass conduit 14.

The bypass seat-engaging member in this embodiment is part of a bypass valve diaphragm 19 which separates a bypass valve chamber 20 from the inlet port. In systems where the bypass seat-engaging member is not part of the bypass valve diaphragm, a mechanical linkage may be used to connect the bypass valve diaphragm to the bypass seat-engaging member so that movements of the bypass valve diaphragm are reflected in the bypass seat-engaging member. The position of the bypass valve diaphragm reflects pressure differences between the bypass valve chamber and inlet port. A pressure drop from the inlet port to the bypass valve chamber works against spring 18 to cause the bypass valve to open. Equal pressure or a pressure rise from the inlet port to the bypass valve chamber will work in concert with spring 18 to hold the bypass valve in a closed position. The bypass valve may be structurally smaller than the main valve, since it provides gas flow under low flow conditions, as will be described later.

A second passage 21 provides gas communication between the inlet port and the bypass valve chamber. A second flow restrictor 22 reduces the flow of gas from the inlet port to the bypass valve chamber via this second passage.

A third passage 24 and a fourth passage 25 provide controlled gas communication from the main and bypass valve chambers to the outlet port, respectively. A regulator valve 26 controls flow modulation in the third passage. The regulator valve may consist of any type of valve capable of controlled variable gas flow. For example, a cup valve and a needle valve are two common designs which may be used. A snap valve 27 controls gas flow in the fourth passage. The snap valve may be any type of valve providing fully closed or open control of gas flow through the valve. The regulator and snap valves may be thought of, and will be referred to as, first and second control valves, respectively. Since a small amount of leakage will occur with most types of regulator valves, the third passage connection to the outlet port should include the snap valve, which will have no leakage when closed. Regulator valve 26 provides variable gas flow through the third passage when the regulator valve is open. Snap 27 valve provides full-on or full-off control of the fourth passage. Both regulator valve 26 and snap valve 27 are normally closed.

Figure 1B:
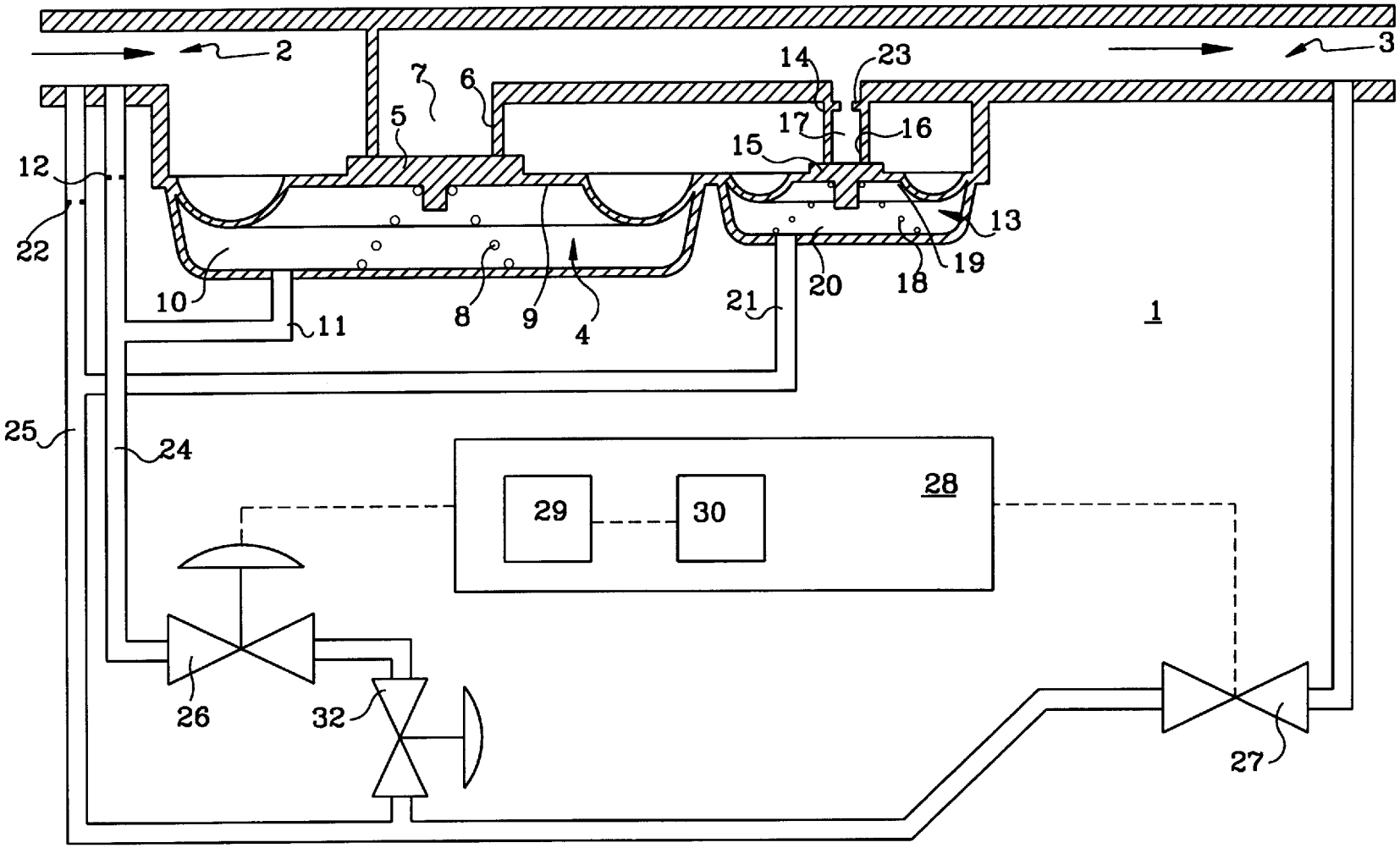
FIG. 1B depicts a partial block diagram of the present invention using a separate valve as a maximum flow control element.

A primary control device, generally indicated by block 28 in FIG. 1A, provides control for regulator valve 26 and snap valve 27. The primary control device includes a temperature sensitive element 29 and a mechanical control apparatus 30, which can communicate temperature changes to the snap valve and regulator valve. Ideally, the mechanical control apparatus will include a maximum flow control element 31, which regulates the maximum gas flow to the outlet port. This maximum flow control element may also be implemented as a further diaphragm operated gas valve in series with the regulator valve as indicated by numeral 32 in FIG. 1B. Maximum flow control by mechanical control apparatus is the preferred method, however.

Figure 2:
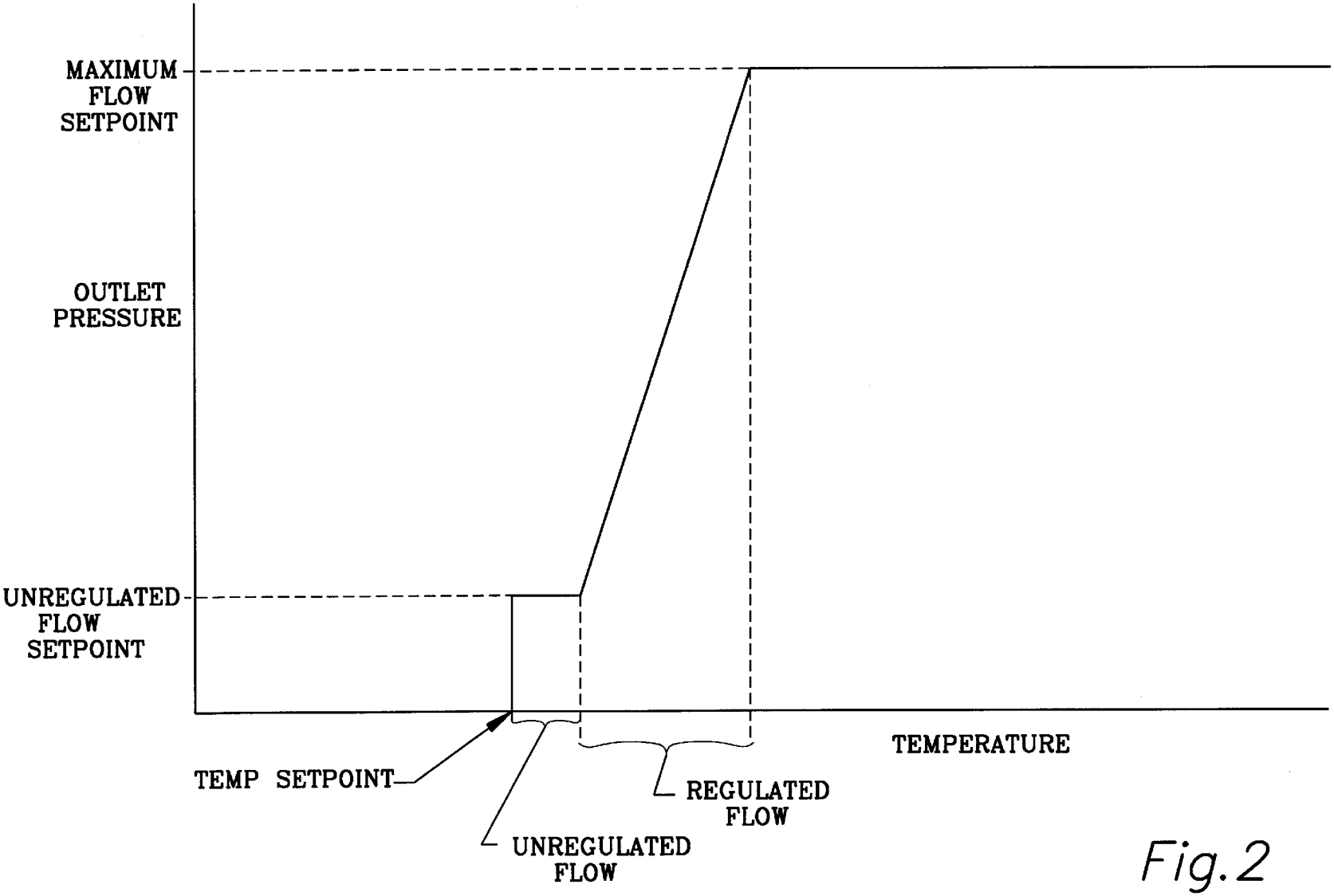
FIG. 2 is a general depiction of the temperature characteristic for the applicants' invention.

As will be described shortly, the primary control device opens snap valve 27 when the temperature sensitive element registers a temperature in a small range below the desired temperature. The main valve will subsequently open if the temperature continues to drop outside this small range. FIG. 2 shows an illustration of the temperature/output pressure characteristics for the applicants' invention.

Operation of the multi-way valve unit is now described. Initially, it is assumed that temperature sensitive element 29 registers a temperature equal to the desired temperature. At this temperature, the primary control device will not open regulator valve 26 or snap valve 27. Consequently, there will be no gas flow through either third passage 24 or fourth passage 25. The first and second passages will however allow the pressure in the main valve chamber and the bypass valve chamber to equalize with the inlet pressure. Equal pressure on either side of the main and bypass valve diaphragms results in both valves remaining closed. No gas will thus flow when a temperature drop is not registered.

If the temperature drops slightly below the desired temperature, primary control device 28 will open snap valve 27. As a result, the bypass valve chamber and the outlet port are essentially placed at equal pressure. Bypass valve diaphragm 19 will register a pressure drop from the inlet port to the bypass valve chamber because second flow restrictor 22 prevents the outlet port or the bypass valve chamber from achieving the inlet pressure. The pressure differential between the bypass valve chamber and the inlet port causes the bypass valve to open. Gas will now flow from the inlet port to the outlet port via the bypass conduit. Flow control may be modified by altering bypass flow control element 23.

Since snap valve 27 only provides on/off control of fourth passage 25, simple unregulated gas flow is provided to the outlet port in this temperature range.

If the temperature continues to drop, the primary control device will eventually open the regulator valve. The point at which the regulator valve opens will depend on the minimum usable flow rate for the main valve. The regulator valve may, for example, be set to open when the gas pressure required to meet the current demand is twice the minimum output pressure of the main valve. For a main valve having 0.3" w.c. minimum output pressure for example, a demand requiring 0.6" w.c gas pressure would cause the regulator valve to begin to open. The main valve chamber and the outlet port will consequently approach equal pressure. The main valve diaphragm will register a pressure drop from the inlet port to the main valve chamber because first flow restrictor 12 prevents the outlet port or the bypass valve chamber from achieving the inlet port pressure. This drop will cause the main valve to open. Gas will now flow directly from the inlet port to the outlet port via main seat passage 7 in the main valve seat. Unlike the snap valve, the regulator valve is capable of temperature regulated control of the gas flow from the inlet port to the outlet port. A continued drop in temperature will thus increase the size of the main valve opening. The main valve will continue to open until the outlet port reaches the demanded pressure, or until maximum flow control element 31 prevents further gas pressure increases.

Figure 3A:
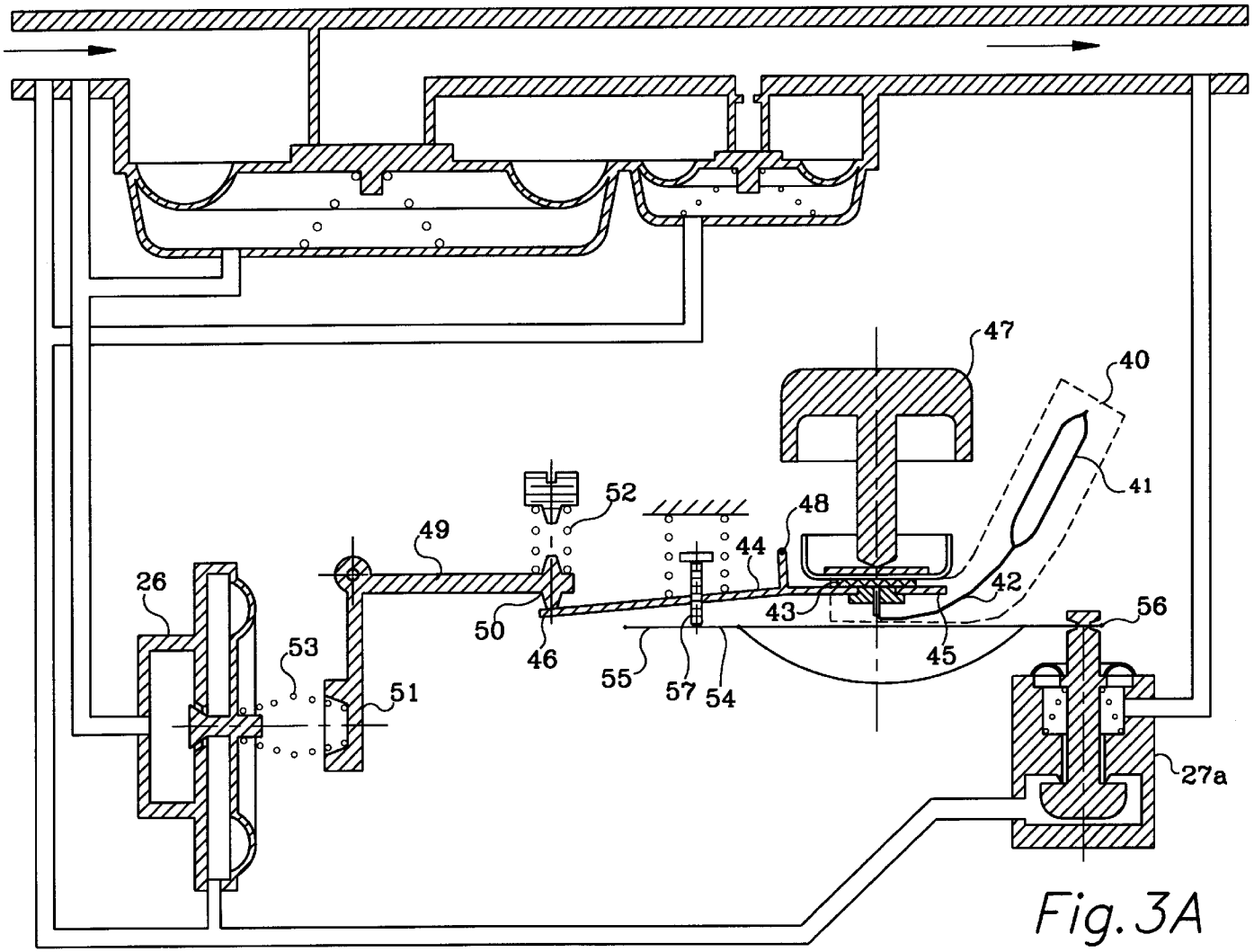
FIG. 3A depicts one possible apparatus for controlling the gas valve system of the present invention.

FIG. 3A depicts use of a bulb operator 40 for controlling the gas valve system of the present invention. Reference numeral 41 generally identifies a liquid-filled bulb which is sealed from the atmosphere. A liquid-filled bulb passage 42 connects the bulb with a bellows 43 which expands and contracts with changes in temperature. Movement of the bellows causes the distance between a first and second engaging faces, located on opposite sides of bellows 43, to vary with temperature. A first lever, generally identified by numeral 44, and having a first end labeled 45 and a second end labeled 46, engages the bellows on one of the engaging faces near first end 45. Temperature changes reflected in the bulb are thus communicated to first lever 44 via bellows 43. A thermostat knob, generally indicated by numeral 47 in FIG. 3A contacts the remaining engaging face of bellows 43. The thermostat knob, upon rotation, varies the position of bellows 43 along a direction generally perpendicular to first lever 44.

A pivot point 48 is defined on the first lever between the first and second ends thereof. A second lever generally identified by numeral 49 has a first end 50 and a second end 51. The second end of first lever 44 engages first end 50 of second lever 49. The first and second levers are arranged so that drops in temperature cause the first lever to be urged in a direction away from second lever 49. A spring 52 urges the second lever toward the first lever. As shown in the FIG. 3A, spring 52 may be utilized as part of a maximum flow adjust means by employing a screw or other means which adjusts the tension of the spring. Second end 51 of second lever 49 engages regulator valve 26 via a spring 53 or other compressible means. Spring 53 absorbs movement of the second lever during the temperature range in which only the snap valve should open. Spring 53 will generally act opposite means internal to the regulator valve which urge the regulator valve closed. The placement of regulator valve 26 and second lever 49 should cause the regulator valve to open when the bulb indicates a drop in temperature.

A snap element 54 has a first end 55 and second end 56. The first lever 44, at a location between second end 46 and pivot point 48, engages the snap element near its first end. The first lever may directly engage snap element 54, or may engage the snap element via an adjustment screw, as depicted at numeral 57 in FIG. 3A. The second end of snap element 54 engages snap valve 27*a*.

Figure 3C:
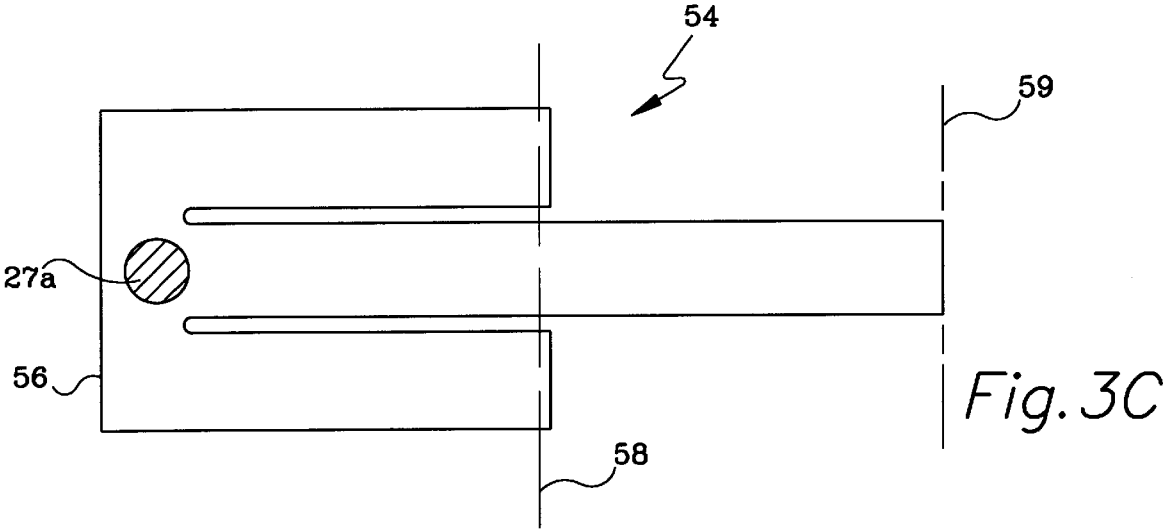
FIG. 3C is a view of the snap element of FIG. 3B taken along lines 3C–3C.
Figure 3B:
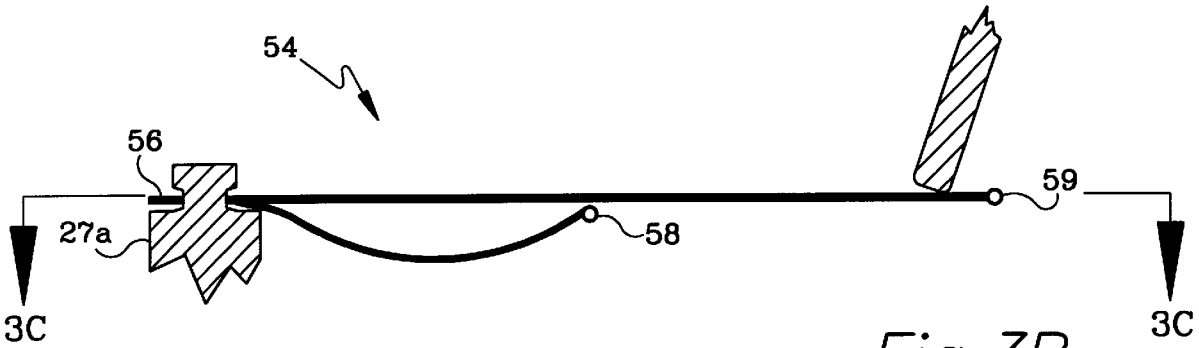
FIG. 3B is an enlarged view of a snap element portion of mechanical control apparatus used in the gas valve embodiment of FIG. 3A.

FIGS. 3B and 3C shows more descriptively the snap element of the applicants' invention. The snap element is constructed of three stiff but flexible, parallel members, joined at second end 56 and separate at first ends 55. The first end of the outside members are fixed at a first pivot point 58. The first end of the inside member is attached to a second pivot point 59. Second end 56 of the snap element attaches to the snap valve. The first lever, directly or through adjustment screw 57, engages the middle member of the snap element at a point near its first end. For proper operation, the engaging point must be between the first pivot point the and first end of the middle member.

The location of the first pivot point should be slightly below a straight line formed from the first end of the middle member to the second end of the middle member. The location of the first pivot point should also place a stretching force on the middle member, and a compressive force on the outside members, causing the outside members to bow away from the middle member.

The mechanical stress in the snap element 54 provides an upward force on the snap valve when the middle member lies above the first pivot point. If on the other hand, the middle member is bowed by the first lever or the adjustment screw below the first pivot point, downward force is applied to the snap valve. Thus, by applying force to the snap element by the first lever or adjustment screw, the snap element is caused to snap from a rest position, which forces the snap valve closed, to a depressed position in which the snap valve is forced open.

As the bulb operator causes the first lever to rotate in a counter clockwise direction, this motion is communicated to the snap element. If the temperature drops below the desired temperature, the middle member of the snap element will move below first pivot point 58, causing the second end of the snap element to rotate downward, thus opening the snap valve. If the temperature rises and the middle member of the snap means moves above the first pivot point again, the second end of the snap element will rotate upward, and the snap valve will close.

Full operation of the primary control device 28 is now described. As the temperature in the monitored space drops, the pressure in bulb 41 drops. The monitored space may for example be a room to be heated. Alternatively, the monitored space may be a water pipe for an on-demand hot water supply system. Bulb passage 42 communicates the pressure drop to bellows 43, causing the bellows to contract. Contraction of the bellows causes first lever 44 to drop. Initially, the drop forces the middle member of rotate element 54 to bow below second pivot point 58. This in turn causes first end 56 of the snap element to snap downwardly, opening the snap valve.

Spring 53 absorbs movement of the first and second levers for small temperature changes, preventing opening of the regulator valve. As the temperature change increases, eventually spring 53 maximally compresses, and the regulator valve will begin to open. Once open, the first and second levers transmit the temperature changes reflected in the bulb to the regulator valve which will also track the temperature changes.

If the temperature change is sufficiently large, second end 46 of first lever 44 may drop enough to disengage from the second lever. Above this temperature, spring 52 will determine the gas flow which reaches the outlet port.

Figure 3D:
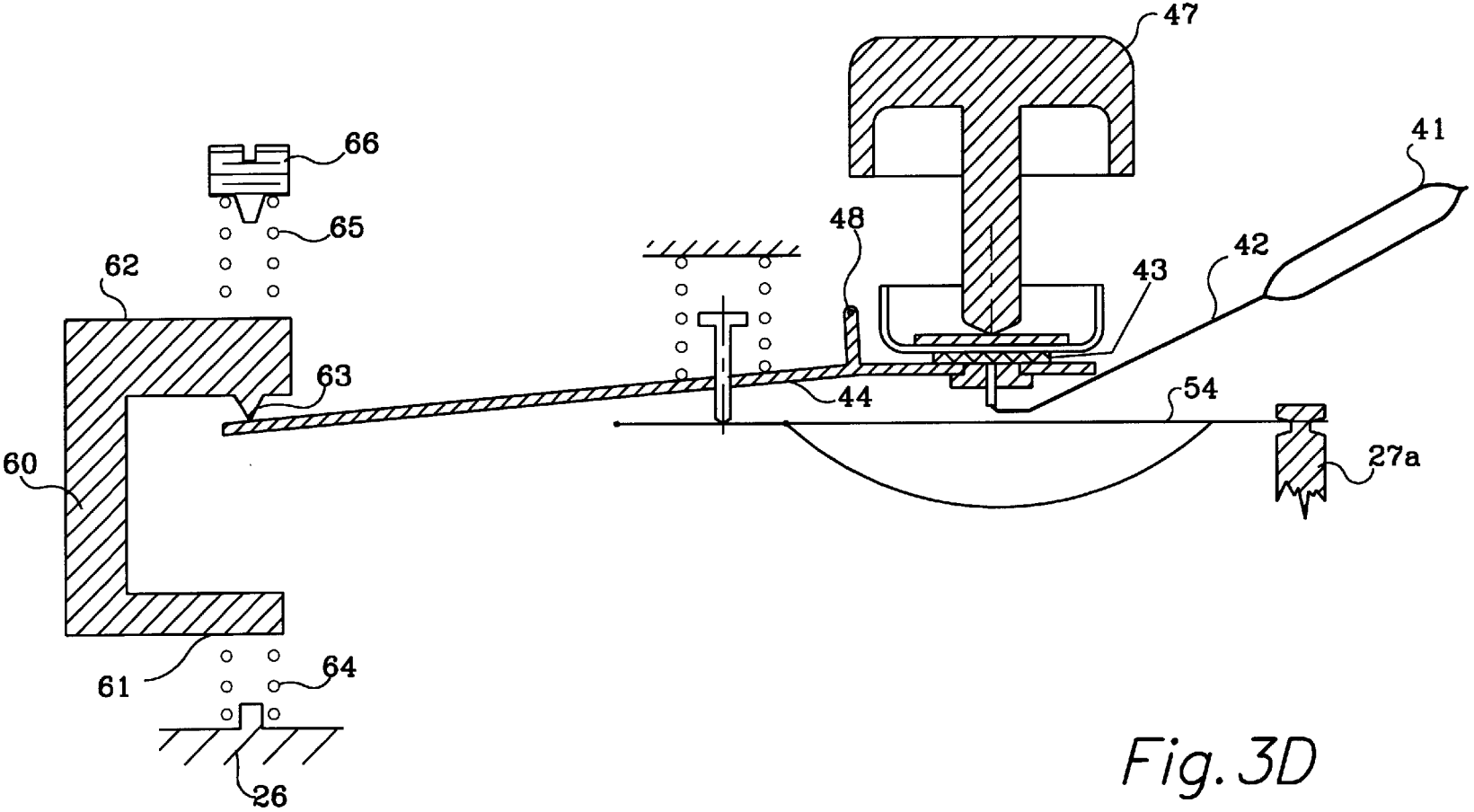
FIG. 3D depicts a second possible apparatus for controlling the gas valve system of the present invention.

FIG. 3D shows a second possible mechanical control apparatus for the applicants' invention. In this embodiment, an engaging member 60 replaces the second lever. Referring to FIG. 3D, engaging member 60 includes first and second spring engaging surfaces, 61 and 62 respectively, and a lever engaging surface 63. The first and second spring engaging surfaces ideally lie parallel to each other, and are situated so that a perpendicular line bisects the midpoint of both surfaces. Spring engaging surfaces 61 and 62 face opposite directions. Lever engaging surface 63 lies generally parallel to the two spring engaging surfaces, and faces the same direction as first spring engaging surface 61. A first spring 64 is compressed between first spring engaging surface 61 and the regulator valve. First spring 64 absorbs movement of the first lever 44 and engaging member 60 within the temperature range in which only the snap valve should open. First spring 64 will generally act opposite means internal to the regulator valve which urge the regulator valve closed. A second spring 65 presses against second spring engaging surface 62 of the engaging member. Second spring 65 may be compressed by a fixed member, such as a valve housing alternatively, it may be compressed by a maximum adjustment screw 66. First lever 44, which engages lever engaging surface 63 generally acts against second spring 65, urging the regulator valve closed.

Initially, first lever 44 acts against spring 65 to hold the regulator valve closed. When the snap valve opens, spring 64 will absorb movement of the first lever in the downward direction, initially preventing the regulator valve from opening. When the first lever moves down sufficiently to maximally compress spring 64, the regulator valve will open. Temperature changes registered by the bulb are thereafter transmitted through the first lever to engaging member 60, causing it to vary the position of the regulator valve, through spring 64. If the temperature drops sufficiently below the desired temperature, the first lever will disengage engaging member 60, and maximum adjustment screw 66 will control flow of gas through the regulator above that temperature.

In accordance with the foregoing description, the applicants have provided an integrated valve unit capable of controlled unregulated flow at low pressures, and regulated flow at higher pressures. Although particular embodiments have been shown and described in illustrative purposes, other implementations which do not depart from the applicants' teachings will be apparent to those of ordinary skill in the relevant arts. It is intended that protection not be limited to a disclosed embodiments, but only by the terms of the following claims.

The embodiments of the invention in which an exclusive property or right is claimed are defined as follows:

1. A multi-way system comprising:

inlet and outlet ports;

a main valve having a main seat and a main seat-engaging member, which when in contact, separate said inlet port from said outlet port, and when separated allow direct communication therebetween, a main valve diaphragm, controlling movement of said seat-engaging member into and out of contact with said main valve seat, and a main valve chamber isolated from the flow path between said inlet and outlet ports by the main valve diaphragm;

a first passage having a first flow restrictor, connecting the main valve chamber and said inlet port;

a bypass conduit in direct communication with said outlet port, having a bypass flow control element;

a bypass valve, having a bypass valve seat and a bypass seat-engaging member, which when in contact, separate said inlet port and said bypass conduit, and when separated allow direct communication therebetween, a bypass valve diaphragm, controlling movement of said bypass seat-engaging member into and out of contact with said bypass valve seat, and a bypass valve chamber, isolated from the flow path between said bypass conduit and said inlet port by the bypass valve diaphragm;

a second passage having a second flow restrictor, connecting the bypass valve chamber and said inlet port;

a third passage, connecting the main valve chamber and said outlet port, said third passage including a regulator valve which hinders flow through said third passage when closed, and allows regulated flow therethrough when open;

a fourth passage, connecting the bypass valve chamber and said outlet port, said fourth passage including a snap valve which prevents flow through said fourth passage when closed, and allows flow therethrough when open; and, a primary control device, including a temperature sensitive element, which causes the snap valve to open when the temperature sensitive element indicates a slightly lower than desired temperature, and causes the regulator valve in said third passage to open when the temperature sensitive element indicates a substantially lower than desired temperature.

2. The multi-way valve unit of claim 1 wherein said primary control device further includes a maximum flow control adjust element capable of limiting the maximum flow of gas when the regulator valve in said third passage is open.

3. The multi-way valve unit of claim 1 wherein said primary control device further includes:

a bulb operator, including a bulb, and a bellows in communication with the bulb, the bellows expanding and contracting in response to temperature changes; and, a mechanical control apparatus which causes the snap valve to open when said bulb operator indicates a slightly lower than desired temperature, and causes the regulator valve in said third passage to open when said bulb operator indicates a substantially lower than desired temperature.

4. The multi-way valve unit of claim 3 wherein the bypass flow control element in said bypass conduit is adjustable.

5. The multi-way valve unit of claim 4 wherein said mechanical control apparatus of said primary control device further includes a maximum flow control adjust element capable of limiting the maximum flow of gas when the regulator valve in said third passage is open.

6. The multi-way valve unit of claim 5 wherein said mechanical control apparatus of said primary control device includes:

a first lever having a first and second ends, in operative communication with the bellows at the first end;

a second lever having a first and a second end, in operative communication with the regulator valve at the second end, and in operative communication with the second end of said first control lever at the first end; and, a snap element in operative connection with said first control lever and the snap valve, for causing the snap valve to maintain only a fully closed or fully open state.

7. The multi-way valve unit of claim 6 wherein:

the snap valve in said fourth passage has only a closed and an open state; and, the regulator valve in said third passage is a needle valve.

8. The multi-way valve unit of claim 6 wherein:

the snap valve in said fourth passage has only a closed and an open state; and, the regulator valve in said third passage is a cup valve.

9. The multi-way valve unit of claim 3 wherein said mechanical control apparatus of said primary control device includes:

a first lever having a first and second ends, in operative communication with the bellows at the first end;

an engaging member, in operative contact with the second end of said first lever, and the regulator valve, said engaging member causing regulated pressure at the outlet port when engaged to said first lever, and causing fixed maximum pressure when said first lever disengages with said first lever mechanism; and, a snap element in operative connection with said engaging mechanism and the snap valve, said snap element causing the snap valve to maintain only a fully closed or fully open state.

10. The multi-way valve unit of claim 9 wherein:

said mechanical control apparatus of said primary control device includes a maximum adjustment screw; and, said engaging member in said primary control device defines a first and a second spring engaging surfaces facing away from each other and a lever engaging surface parallel to the spring engaging surfaces and facing the same direction at the first spring engaging surface, a first spring compressed between a regulator valve and the first engaging surface, and a second spring compressed between a second spring engaging surface and the maximum adjustment screw of said mechanical control means, the lever engaging surface engaged by the first lever in one temperature range and not engaged thereby during a second temperature range.

11. A valve system providing dual-mode gas flow control having first and second diaphragm valves, the diaphragm valves defining a common inlet port and outlet port for providing gas into and out of the valve system, respectively, said first and second diaphragm valves having associated therewith first and second valve diaphragms and first and second diaphragm valve chambers, respectively, the valve diaphragms separating said inlet port from the valve chamber of each diaphragm valve, pressure differences from the valve chamber to said inlet port causing actuation of each diaphragm valve, the improvement comprising:

said second diaphragm valve providing substantially lower gas flow than said first diaphragm valve;

first control valve connected to the first diaphragm valve chamber of said first diaphragm valve, said first control valve, when open, lowering the pressure in the first diaphragm valve chamber of said first diaphragm valve sufficient to cause said first diaphragm valve to open, said first control valve further capable of regulated control of pressure in the first diaphragm valve chamber, second control valve connected to the second diaphragm valve chamber of said second diaphragm valve, said second control valve, when open, lowering the pressure in the second diaphragm valve chamber of said second diaphragm valve sufficient to cause said second diaphragm valve to open, said second control valve further capable of only fully opening or fully closing said second diaphragm valve; and, a primary control means, for operating said first and second control valves, said primary control means causing said second control valve to open under moderate gas demand, and causing said first control valve to provide regulated gas flow under heavy gas demand.

12. The gas valve system of claim 11 wherein operation of said first and second control valves occurs over a continuous supply curve whereby as demand for gas increases from no gas demand to high gas demand, the valve system provides low unregulated pressure during low demand, and high regulated pressure when high demand is reached.

13. The valve system of claim 12 further comprising:

first passage connecting said inlet port to the first diaphragm valve chamber of said first diaphragm valve, said first passage communicating pressure changes at said inlet port to the first diaphragm valve chamber when said first control valve is regulating, and causing equalization of pressure in at said inlet port and first diaphragm valve chamber when said first control valve is closed;

second passage connecting said inlet port to the second diaphragm valve chamber of said second diaphragm valve, said second passage communicating pressure changes at said inlet port to the second diaphragm valve chamber when said second control valve is open, and causing equalization of pressure at said inlet port and second diaphragm valve chamber when said second control valve is closed;

third passage connecting said first control valve between the first diaphragm valve chamber and said outlet port, said third passage causing partial equalization of pressure between the first diaphragm valve chamber and said outlet port, said first control valve controlling the degree of regulation therebetween; and, fourth passage connecting said second control valve between the first diaphragm valve chamber and said outlet port, said fourth passage causing full equalization of pressure between the second diaphragm valve chamber and said outlet port, said second control valve controlling equalization therebetween.

14. The valve system of claim 12 wherein said primary control means includes a temperature sensing means for sensing temperature to be communicated to the valve system as an indication of gas demand, and a mechanical control means for communicating the sensed temperature to said first and second control valves, whereby the state of the control valves reflects differences between the desired temperature and the sensed temperature.

15. The valve system of claim 14 wherein said primary control means includes a maximum flow control means for regulating the maximum gas pressure which can be delivered to said outlet port.

16. The valve system of claim 15 wherein the temperature sensing means in said primary control means comprises bulb operator, defining a bulb volume, changes in the bulb volume being communicated to the mechanical control means.

17. The valve system of claim 14 wherein the mechanical control means of said primary control means includes snap means and lever means, the snap means for forcing said second control valve to define a fully closed state when there is no gas demand, and to define a fully open state at low or moderate gas demand, and the lever means for causing the first control valve to define a closed state at low or moderate gas demand and to define a regulating state at high gas demand, movement of the snap means and lever means being controlled by the temperature sensitive means.

18. The valve system of claim 17 wherein the snap means in the mechanical control means of said primary control means comprises a flexible element subject to mechanical stresses which cause it to snap from a rest to a depressed position upon mechanical force being applied thereto.

19. The valve system of claim 18 wherein the mechanical control means of said primary control means includes a first lever, the first lever having first and second ends, and a pivot point located between the first and second ends, the first lever contacting the temperature sensitive means at the first end, and contacting said snap means between the pivot point and the second end of the first lever, the mechanical control means also including a second lever having first and second ends, the first end of the second lever contacting the second end of the first lever, and the second end of the second lever in communication with said first control valve whereby temperature changes in the temperature sensitive means are communicated through the first and second levers to said first control valve, and through the first lever and snap means to said second control valve.

20. The valve system of claim 19 wherein the first lever disengages from the second lever when a maximum desired flow is reached.

21. The valve system of claim 19 wherein the second lever is prevented from causing further opening of said first control valve when a maximum desired flow is reached.

22. The valve system of claim 19 wherein the second lever engages said first control valve through a spring, which absorbs movement of the second lever during periods of low or moderate gas demand.

* * * * *